US010040161B2

(12) United States Patent
Wagner et al.

(10) Patent No.: US 10,040,161 B2
(45) Date of Patent: Aug. 7, 2018

(54) GEMSTONE POSITIONING FIXTURE

(75) Inventors: Randall M. Wagner, Mequon, WI (US); Kurt P. Schoeckert, Hartford, WI (US)

(73) Assignee: GemEx Systems, Inc., Mequon, WI (US)

( * ) Notice: Subject to any disclaimer, the term of this patent is extended or adjusted under 35 U.S.C. 154(b) by 790 days.

(21) Appl. No.: 12/603,575

(22) Filed: Oct. 21, 2009

(65) Prior Publication Data

US 2010/0102039 A1 Apr. 29, 2010

Related U.S. Application Data

(60) Provisional application No. 61/196,823, filed on Oct. 21, 2008.

(51) Int. Cl.

| | |
|---|---|
| ***B24B 9/00*** | (2006.01) |
| ***B24B 9/16*** | (2006.01) |
| ***B28D 5/00*** | (2006.01) |

(52) U.S. Cl.

CPC ..... *B24B 9/161* (2013.01); *B28D 5/0082* (2013.01); *Y10T 29/23* (2015.01)

(58) Field of Classification Search

CPC ..... B24B 9/16; B24B 9/161; B24B 9/162; B24B 9/163

USPC ..... 219/121.28, 121.3, 121.31, 121.69, 219/121.68, 121.85

See application file for complete search history.

(56) References Cited

U.S. PATENT DOCUMENTS

| | | | | |
|---|---|---|---|---|
| 4,189,230 | A * | 2/1980 | Zasio | 355/76 |
| 4,629,384 | A * | 12/1986 | Beshke et al. | 414/222.04 |
| 5,458,733 | A * | 10/1995 | Tessmer et al. | 216/67 |
| 5,760,367 | A * | 6/1998 | Rosenwasser et al. | 219/121.69 |
| 6,035,522 | A * | 3/2000 | Larson et al. | 29/760 |
| 6,553,644 | B2 * | 4/2003 | Karmaniolas et al. | 29/559 |
| 7,336,347 | B2 * | 2/2008 | Sasian et al. | 356/30 |
| 2006/0144821 | A1 * | 7/2006 | Wang | 216/66 |
| 2008/0006615 | A1 * | 1/2008 | Rosario et al. | 219/121.68 |

OTHER PUBLICATIONS

Search report dated Feb. 3, 2010, for International Application No. PCT/US 09/61565.

* cited by examiner

*Primary Examiner* — Dana Ross
*Assistant Examiner* — Ayub Maye
(74) *Attorney, Agent, or Firm* — Nicholas A. Kees; Godfrey & Kahn S.C.

(57) ABSTRACT

A gemstone positioning fixture, including a base and a cover plate applied over the base. The cover plate has apertures, one for each gem to be worked on. At least one biasing member is positioned beneath the plate. The biasing member applies an upward force to the gems to contact the cover plate. The plate is formed of materials that conduct electricity, so as to conduct any charged particles away from the gem work surface.

18 Claims, 9 Drawing Sheets

GEMSTONE POSITIONING FIXTURE

CROSS REFERENCE TO RELATED APPLICATION

This application claims the benefit of Provisional Application Ser. No. 61/196,823, filed Oct. 21, 2008.

BACKGROUND OF THE INVENTION

This invention relates to gemstone positioning fixtures, and in particular to such fixtures generally for use in connection with engravements made with electron beam or ion beam sources.

New technology has emerged in the jewelry and gemstone industry that allows for the nano-engraving of the table of a polished gemstone, so small as to not be visible to the naked human eye, or even with a common 10× loop. This nano-engraving is done with sophisticated focused ion beams (charged particles) that ablate the surface of the gemstone on the scale of about 30 nanometers deep. The targeting and manipulation of the ion beam is done on such a small scale, and with such power, that the charged ion particles are prone to build up an electrical charge on the surface of gemstone as it is engraved. This build-up of electrical charge can cause the ion beam to spread or distort, resulting in an unpredictable engravement on the gem table surface. Current practice requires preparing the gemstone for engraving using a conductive coating like gold, and then affixing the coated gemstone to a grounded fixture using a conductive adhesive. This process requires specialized handling of the gemstones requiring extra time and adding the risk of breaking of fragile parts the gemstone. Additionally, the use of adhesives and grounding holders allows for significant misalignment of the individual gemstones that must be corrected in time consuming programming of the focused ion beam device.

This invention relates to improvements to the systems described above, and to solutions to some of the problems raised or not solved thereby.

SUMMARY OF THE INVENTION

The gemstone positioning fixture of the present invention is designed to securely hold single or multiple gemstones in such a way as to be properly positioned for processing in manufacturing or grading, including nano-scale engraving using focused ion or electron beams without having to coat the gemstones or attach the gemstones to a holder with adhesive. The design of the fixture causes the gemstone to be held without adhesives while allowing any electrical charge to be siphoned to ground. Additionally, alignment and centering of the gemstones relative to the manufacturing or grading processing is achieved mechanically through the features designed into the fixture, thereby eliminating the need for custom programming and targeting of the processing equipment on the individual gemstones. The fixture is useful for positioning gemstones for any number of processes in the manufacture and grading of gemstones, including methods of shaping, engraving or cutting using lasers or other charged beams even though such other methods may not have dissipation of electrical charge as a problem. The present invention may be used by gemstone and jewelry manufacturers and grading companies having a need to securely hold the gemstone in a predetermined alignment for processing, including the process of engraving gemstones.

The invention therefore provides a gemstone positioning fixture, including a cover plate and base. The base supports the covering plate. The cover plate has a number of apertures matching in position and number the gems to be worked. A biasing member is positioned beneath the apertures. The biasing member bears on a support plate with a top surface adapted to receive and support a gem in a position so that a working surface of the gem faces the aperture. The biasing member may be a coil spring, a leaf spring, or other type of biasing member.

Another embodiment of the invention provides a gemstone positioning fixture, including a base. The base has one or more plunger holes formed therein. A cover plate is applied over the base. The cover plate has a number of apertures matching in position and number the plunger holes in the base. A biasing member is positioned within one or more of the plunger holes. A plunger is positioned atop each biasing member within the respective plunger hole, and has a top surface adapted to receive and support a gem in a position so that a working surface of the gem faces away from the plunger. A fixture base plate has spring compression pins, and is positioned at the bottom of the base. A spring compression base plate has holes which align in number and position with the spring compression pins, and the spring compression pins are inserted into those holes. A spring compression plate is positioned above the spring compression base plate and below the biasing members, and in contact with the spring compression pins. Thus, when the fixture base plate is applied, the spring compression pins contact the spring compression plate, which in turn provides an upward force to the biasing members, the plungers and the gems. The cover plate, and possibly others of the parts, are formed of materials that conduct electricity, so as to conduct any charged particles away from the gem working surface.

Other objects and advantages of the invention will become apparent hereinafter.

DETAILED DESCRIPTION OF THE INVENTION

Figure 1:
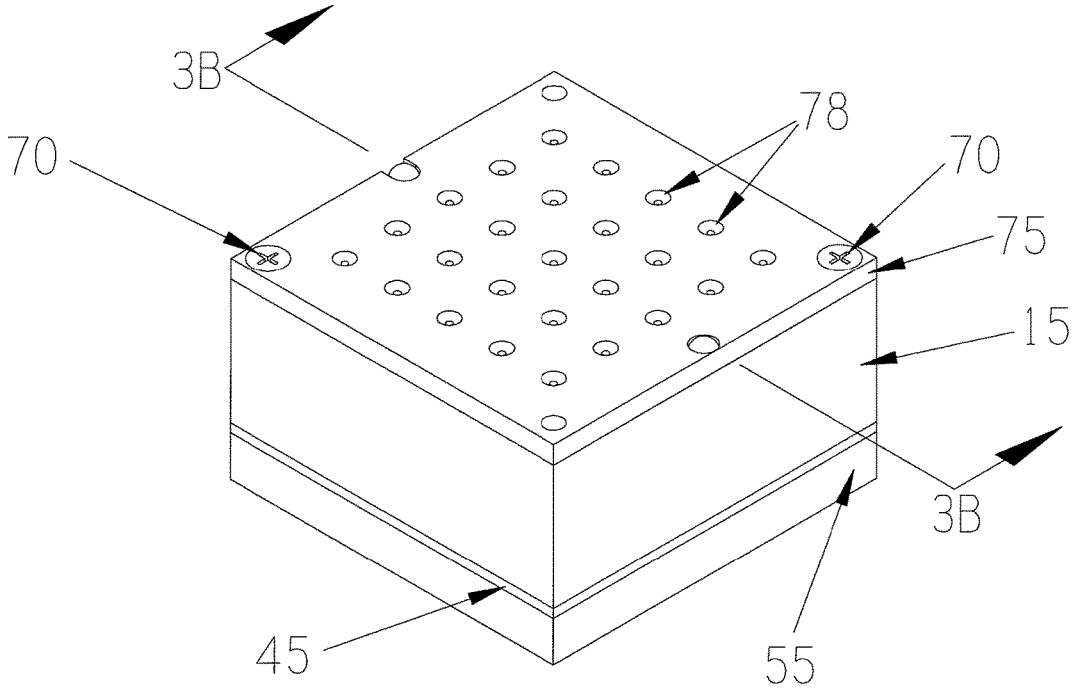
FIG. 1 is a perspective view of a fixture constructed according to one embodiment of the invention.
Figure 2:
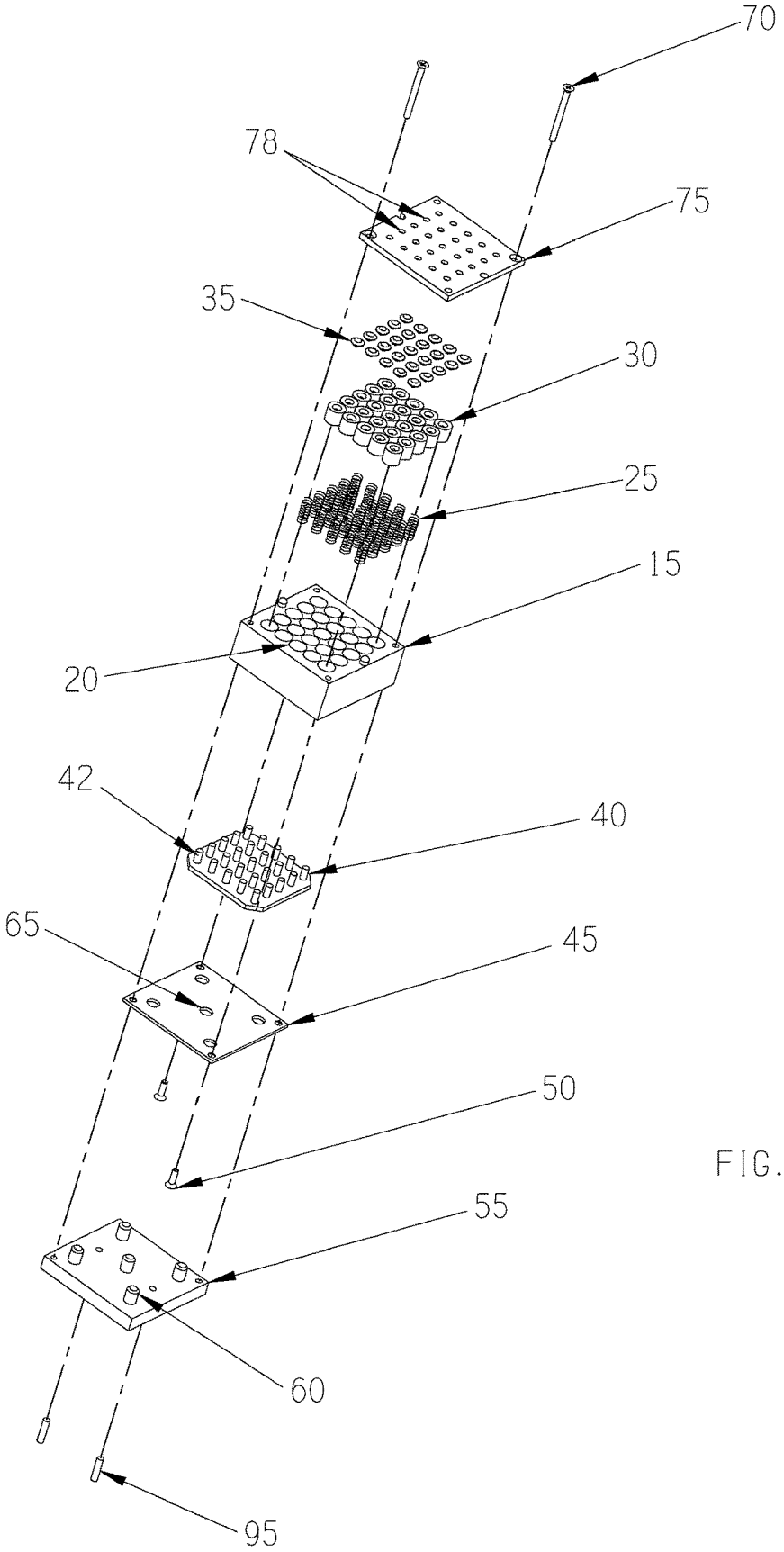
FIG. 2 is an exploded view, in perspective, of the fixture shown in FIG. 1.

The present invention provides a gemstone positioning fixture 10, for positioning a gem 35 and presenting a work surface 36 of the gem for certain work. The work includes the use of a high energy particle beam such as an ion beam and/or electron beam to direct charged particles onto the work surface 36 to engrave indicia, such as numbers or bar codes, onto the work surface.

In the embodiments shown in FIGS. 2-5, the fixture 10 includes a base 15. The base 15 shown in the drawing figures has the shape of a rectangular solid, with a substantially square cross section in one direction, which we will call horizontal, and rectangular sides, but many other shapes could be used. The base 15 has one or preferably a number of plunger holes 20 formed entirely through the base, preferably in a substantially vertical direction, although any direction or desired angle could be included.

Within each plunger hole 20 in the base 15 is positioned a biasing member 25. Each biasing member 25 co-acts with a plunger 30. The plunger 30 has substantially the same cross sectional shape as the plunger hole 20, with outside dimensions just smaller than the dimensions of the plunger hole, so as to allow the plunger to move freely vertically in the plunger hole without significant lateral movement. In the embodiment shown in the figures, the plunger holes 20 and the plungers 30 are cylindrical, and the diameter of the plunger just smaller than the diameter of the plunger hole. Each plunger 30 preferably has a bottom surface adapted and shaped to interact with the biasing member 25, such as cupped to interact with a coil spring. The top surface of each plunger 30 is shaped to interact with a gem 35 so as to provide support without exerting undue force on portions of the gem that are more fragile, and to present the surface of the gem to be worked or speculated, hereafter called the work surface 36, at the top. Gem 35 could be a rough, uncut, gem, or a cut gem, and could be a diamond, ruby, sapphire or other precious gem.

For the instance where the gem 35 is a diamond and the work surface 36 is the table, or top surface, of the diamond, the top surface of the plunger 30 is shaped with a depression, with its lowest point at the center, so that the center lowest point 37, or culet, of the diamond, is well supported. The plunger 30 could even have a cone-shaped depression formed in its top surface. Further, an opening 32 could be formed in the top surface of the plunger 30, generally at its center, to place the least amount of force possible on the culet in supporting the gem 35.

Figure 3A:
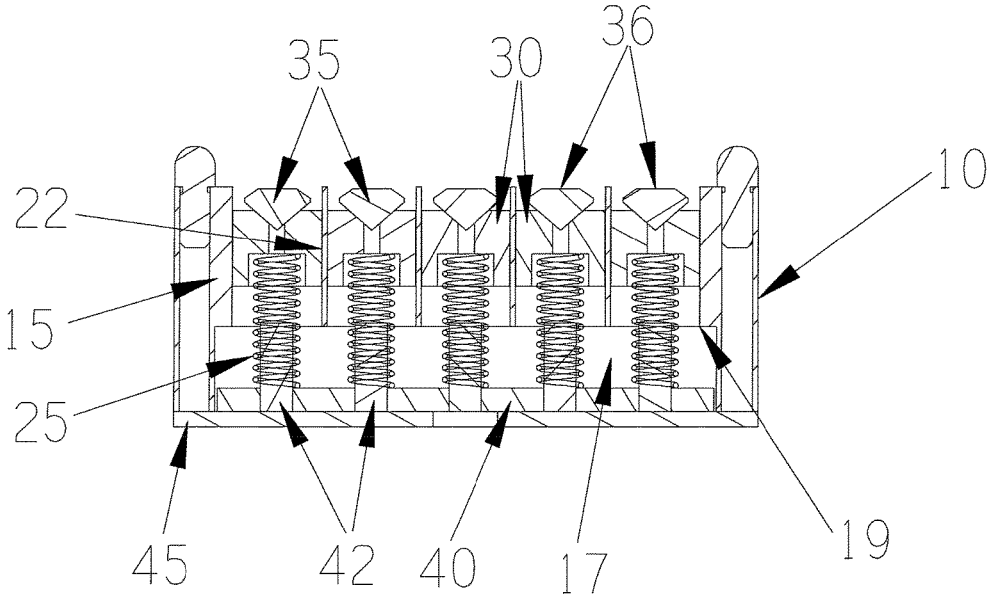
FIG. 3A is sectional view of a fixture substantially as shown in FIG. 1, partially disassembled.
Figure 3B:
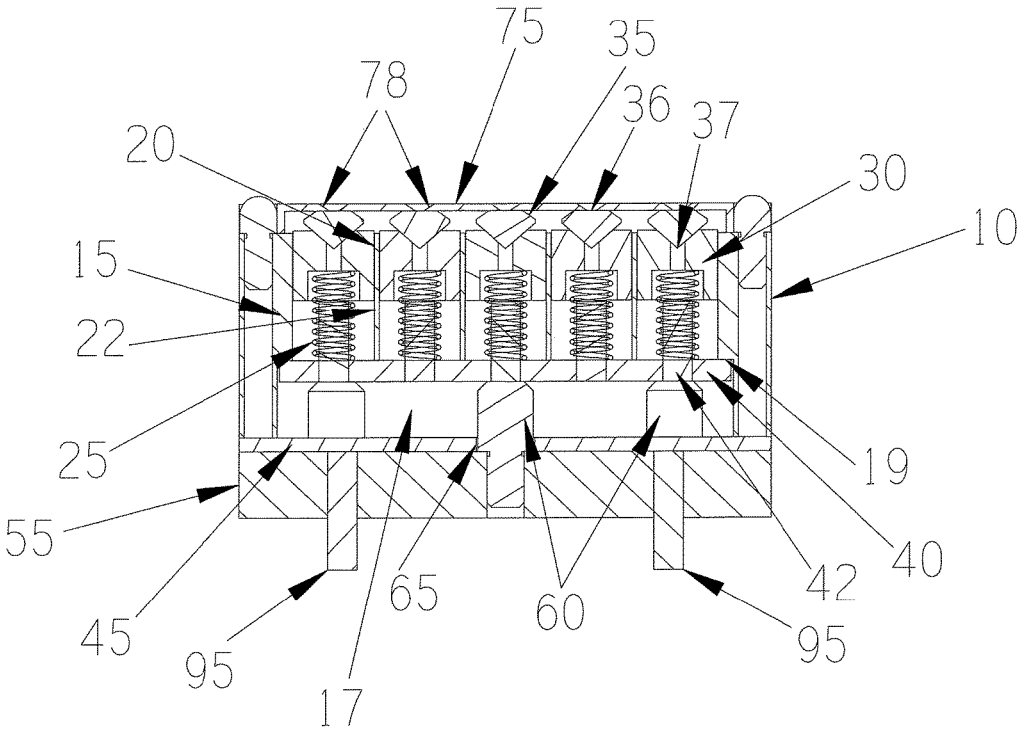
FIG. 3B is a sectional view, taken along line 3-3, of the fixture shown in FIG. 1.

In the embodiments shown, referring now mainly to FIGS. 3A and 3B, the walls 22 of the plunger holes 20 extend only part way down inside the base 15, so that a more open chamber 17 is formed within the underside of the base. The upper extent of the chamber 17 is formed by a shoulder 19 that extends around the inside perimeter of the underside of the base 15, and the bottom edges of the walls 22. The bottom ends of plunger holes 20 thus coincide with the top of the chamber 17. In the most preferred version of this embodiment, a bottom spring compression plate 40 is positioned, and sized so as to fit, within chamber 17, and be movable up and down within the chamber. In the most preferred version of this embodiment, the biasing member 25 is a coil spring, and spring compression plate 40 may optionally be provided with a set of positioning pins 42, each sized so as to fit within the coil springs, and positioned so as to position the springs generally so as to fit within and align with the plunger holes 20. Positioning pins 42 have the advantage of facilitating assembly of the fixture 10, so that the coil springs may be simply dropped into the holes 20 and substantially position themselves.

In a preferred version of this embodiment, chamber 17 is preferably closed by a spring compression base plate 45 securely attached to the base 15, trapping the bottom spring compression plate 40 within chamber 17. In the embodiments shown, the attachment of the spring compression base plate 45 is by means of fasteners 50 (shown in FIG. 2) that pass through the spring compression base plate 45 and are threaded into the underside of the base 15. Any other suitable means of attachment may be used, including but not limited to adhesive, solder, and welding. With the biasing member 25 resting on the bottom spring compression plate 40 and the bottom spring compression plate 40 resting on the spring compression base plate 45, the biasing member and the plunger 30 are sized with an uncompressed height so as to support the work surface 36 of the gem 35 at a desired level, generally at or below the top surface of the base 15, as shown in FIG. 3A.

A preferred version of this embodiment of fixture 10 further includes a fixture base plate 55, which is provided with spring compression pins 60 attached to or integrally formed with the fixture base plate and projecting substantially vertically upward. Fixture base plate 55 is sized and positioned to cover the underside of the spring compression base plate 45. As shown best in FIGS. 2 and 3B, spring compression base plate 45 includes a certain number of holes 65 matching the number of spring compression pins 60, and the holes 65 and pins 60 are positioned to align with each other. Thus when fixture base plate 55 is applied to the spring compression base plate 45, and connected to the base 15 by any suitable means such as fasteners 70, the spring compression pins 60 bear on spring compression plate 40, forcing plate 40 upward within chamber 17. This assembly thereby provides an upward force, moving biasing members 25, plungers 30 and gems 35 upward.

In the most preferred version of this embodiment, shown in FIG. 3B, prior to the application of the upward force by the fixture base plate 55 as described above, a cover plate 75 is applied over the top surface of the base 15. Cover plate 75 may be fastened to the top surface of the base 15 by the same fasteners 70 as used to connect the base and the fixture base plate 55. Cover plate 75 is provided with a number of apertures 78, matching in number and alignment the plunger holes 20, so that each aperture 78 is placed over one gem 35 in the fixture 10, although not necessarily centered over the gem or even the work surface 36 of the gem.

Figure 5:
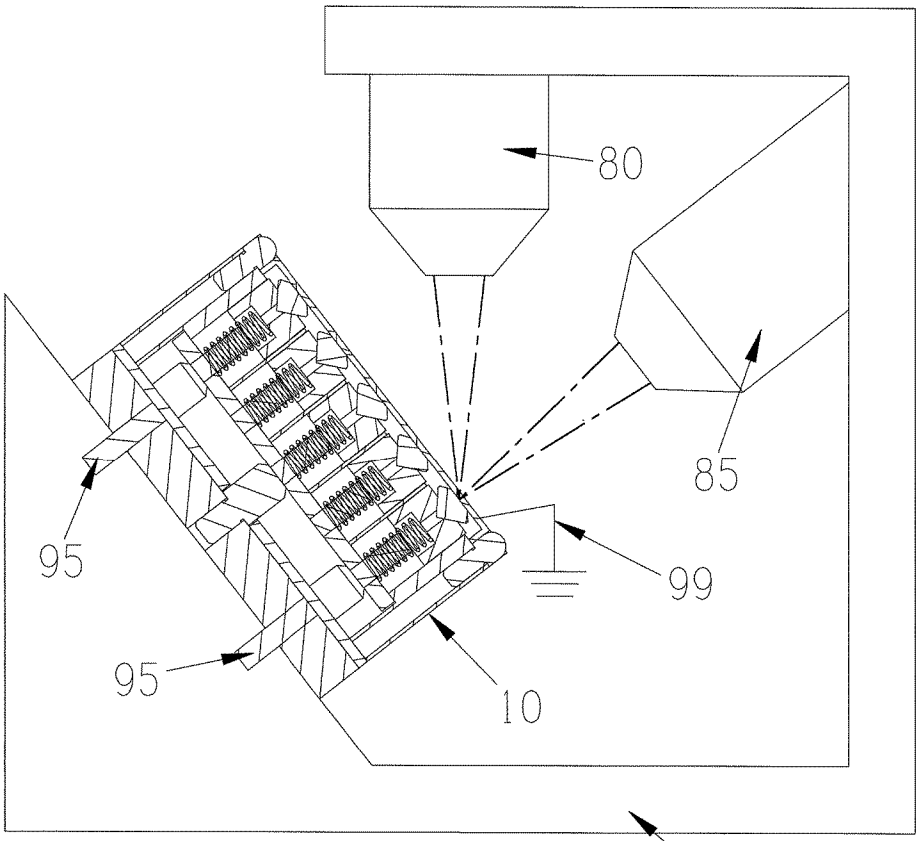
FIG. 5 is a sectional view of the fixture provided by the invention, shown as part of an overall apparatus that includes electron beam and ion beam devices.

Then, when the upward force is applied by the fixture base plate 55, the spring compression pins 60 bear on spring compression plate 40, forcing plate 40 upward within chamber 17, thereby moving biasing members 25, plungers 30 and gems 35 upward until the work surfaces 36 of the gems 35 contact the underside of the cover plate 75. The gems 35 are thus held securely in position, and the work surface 36 of each gem suitably exposed, for the application of a high-energy particle beam, such as an electron beam 80 and/or an ion beam 85, as shown in FIG. 5. The fixture 10 is securely affixed into a focused ion beam instrument 90 by means of fixture mounting pins 95.

In the most preferred version of this embodiment, the cover plate 75, as well as possibly other parts, are made of conductive material, such as copper, brass, aluminum, steel, and so on, and the entire fixture, especially the cover plate 75 is connected to an electrical ground 99, and the size of the apertures 78 is determined, so that any electrical charges that might otherwise build up on any of these parts is suitably and harmlessly conducted away from the work surface 36 itself.

Figure 4:
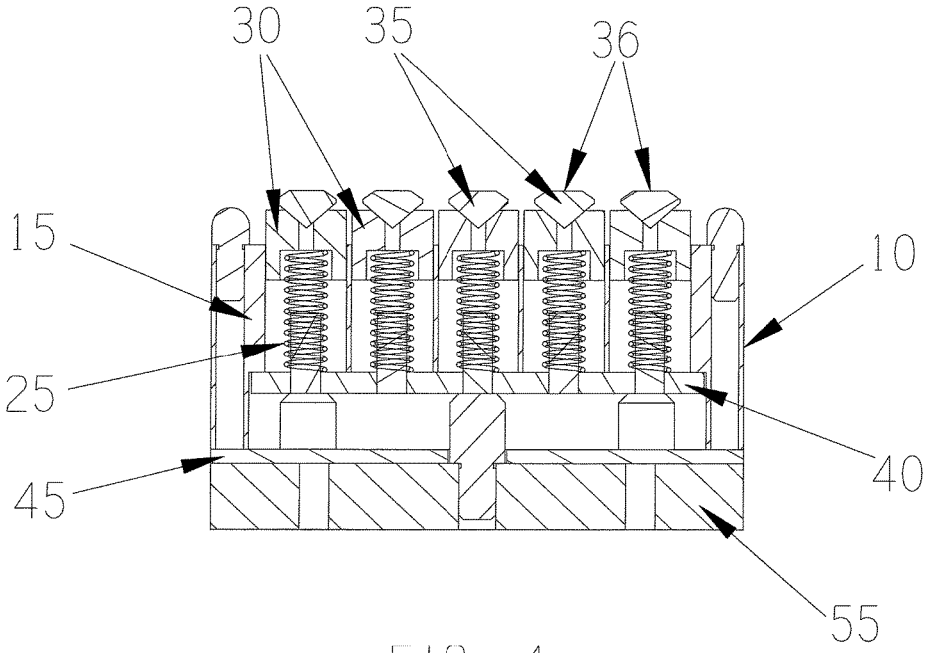
FIG. 4 is a sectional view of an embodiment of the invention where there is no cover plate.

In the embodiment shown in FIG. 4, there is no cover plate 75 as a part of the fixture 10. In that instance, once the fixture base plate 55 is applied, the work surfaces 36 of the gems 35 would extend a bit above the top edge of the base 15. This embodiment would be applied in a situation where the instrument 90 had its own plate similar in structure and material to cover plate 75.

Figure 6:
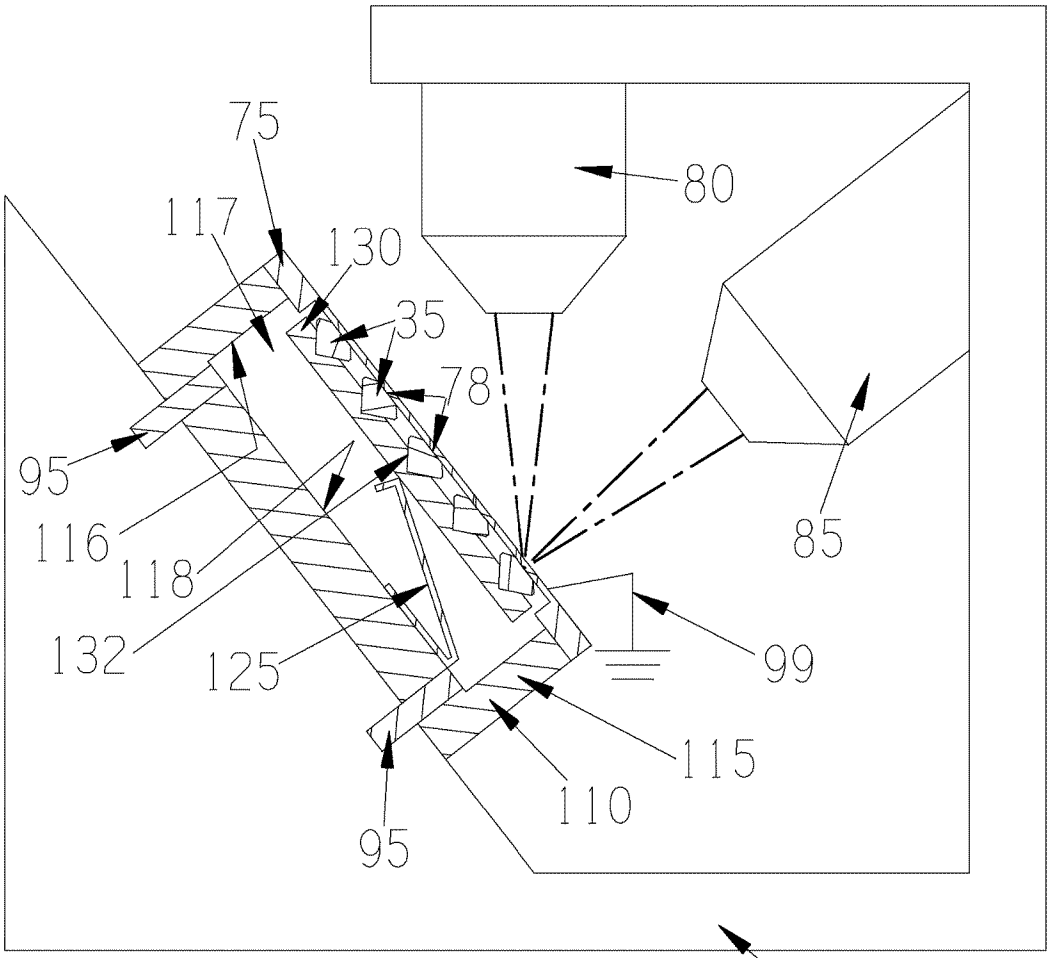
FIG. 6 is a sectional view of a different embodiment of the fixture provided by the invention, shown as part of an overall apparatus that includes electron beam and ion beam devices.

A fixture 110 according to another embodiment of the invention is shown in cross section in FIG. 6. Fixture 110 includes a body 115 that has sides 116 and a bottom surface 118, but is substantially open in the center area, forming a cavity 117. Disposed within cavity 117 is a biasing member 125, depicted as a v-shaped metal part (although other shapes would work just as well) formed of flexible but resilient material such as spring steel. One leg 126 of biasing member 125 bears on the bottom surface 118 of the cavity 117 of the body 115, and a second leg 127 bears away from the bottom surface 118. A gem support plate 130 is also disposed in the cavity 117. Gem support plate 130 is sized so as to just, but freely, fit within the horizontal cross section of the cavity 117 as shown in FIG. 6. Further, gem support plate 130 is positioned to rest upon and be supported by the second leg 127 of biasing member 125. Gem support plate 130 is provided with at least one opening 132, and preferably a number of openings 132. Gems 35 are placed in the openings 132, in the side of gem support plate 130 opposite the side the faces the second leg 127. Similar to the embodiments described and shown in FIGS. 1-5, a cover plate 75 is placed over the top of body 115, and secured thereto with a suitable attachment. Cover plate 75 includes apertures 78, preferably matching in number, although not necessarily alignment, the openings 132, so that each aperture 78 is placed over one gem 35 in the fixture 110. Again, the apertures 78 are not necessarily centered over the gem 35 or even the work surface 36 of the gem. Here again, the cover plate 75, as well as possibly other parts, are made of conductive material, such as copper, brass, aluminum, steel, and so on, and the entire fixture, especially the cover plate 75 is connected to an electrical ground 99, so that any electrical charges that might otherwise build up, on the work surface 36 or any of these parts, is suitably and harmlessly conducted away from the work surface 36 itself. Further, the size of the apertures 78 is determined so as contribute to this functionality of conducting away charged particles.

Figure 7:
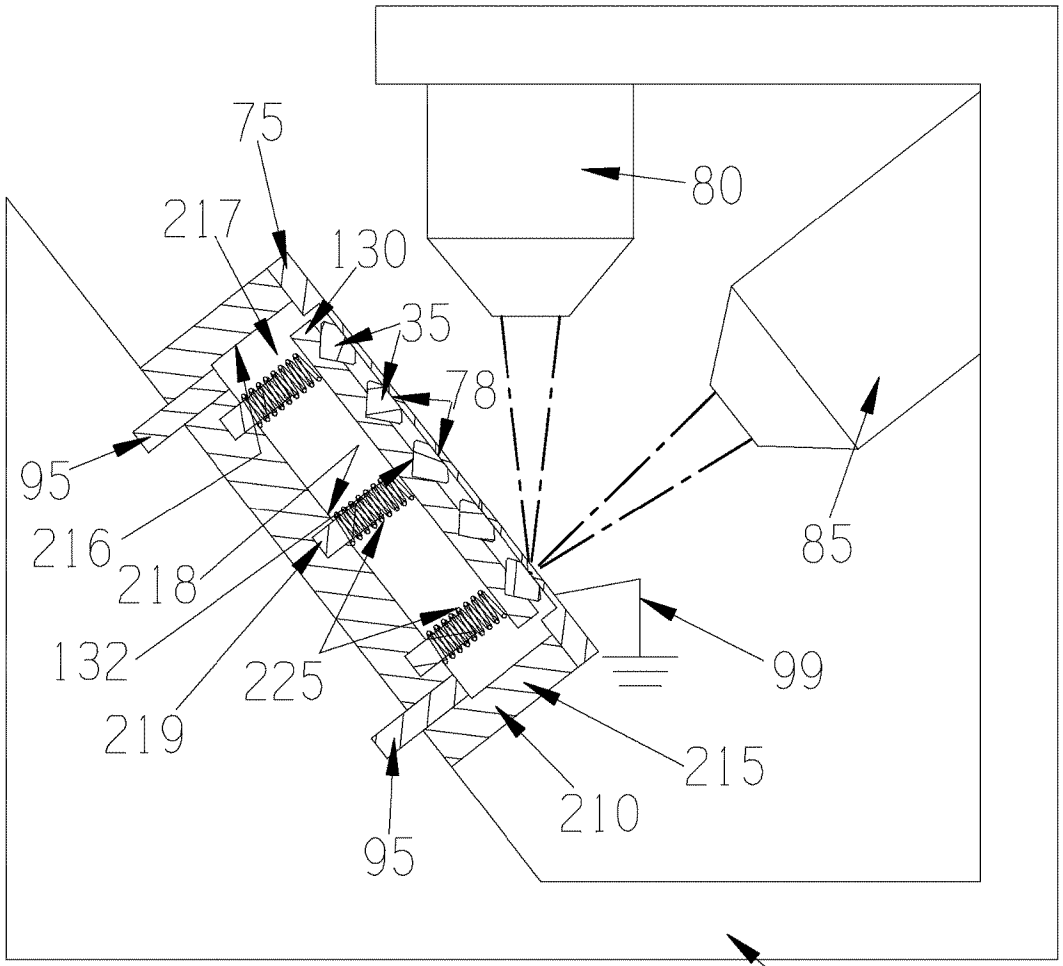
FIG. 7 is a sectional view of yet another embodiment of the fixture provided by the invention, shown as part of an overall apparatus that includes electron beam and ion beam devices.

A fixture 210 constructed according to yet another embodiment of the invention is shown in FIG. 7. Fixture 210 includes a body 215 that has sides 216 and a bottom surface 218, and is substantially open in the center area, forming a cavity 217. Mounted in the bottom surface 218 are one or preferably a number of positioning pins 242, which extend part way into the cavity 217. One or more of the positioning pins 242 has applied over it a biasing member 225, depicted as a coil spring. The uncompressed length of the biasing member 225 is longer than the length of the positioning pin 242. Similar to the embodiment shown in FIG. 6, a gem support plate 130 is also disposed in the cavity 217, sized so as to just, but freely, fit within the horizontal cross section of the cavity 217 as shown in FIG. 7, and resting upon and supported by the biasing members 225. Gem support plate 130 is provided with openings 132, and gems 35 are placed in the openings 132, in the side of gem support plate 130 opposite the side the faces the biasing members 225. Similar to the embodiments described above, a cover plate 75 is placed over the top of body 215, and secured thereto with a suitable attachment. Cover plate 75 includes apertures 78, preferably matching in number, although not necessarily alignment, the openings 132, so that each aperture 78 is placed over one gem 35 in the fixture 210. Here again, the apertures 78 are not necessarily centered over the gem 35 or even the work surface 36 of the gem. And again, the cover plate 75, as well as possibly other parts, are made of conductive material, such as copper, brass, aluminum, steel, and so on, and the entire fixture, especially the cover plate 75 is connected to an electrical ground 99, so that any electrical charges that might otherwise build up, on the work surface 36 or any of these parts, is suitably and harmlessly conducted away from the work surface 36 itself. Further, the size of the apertures 78 is determined so as contribute to this functionality of conducting away charged particles.

Figure 8:
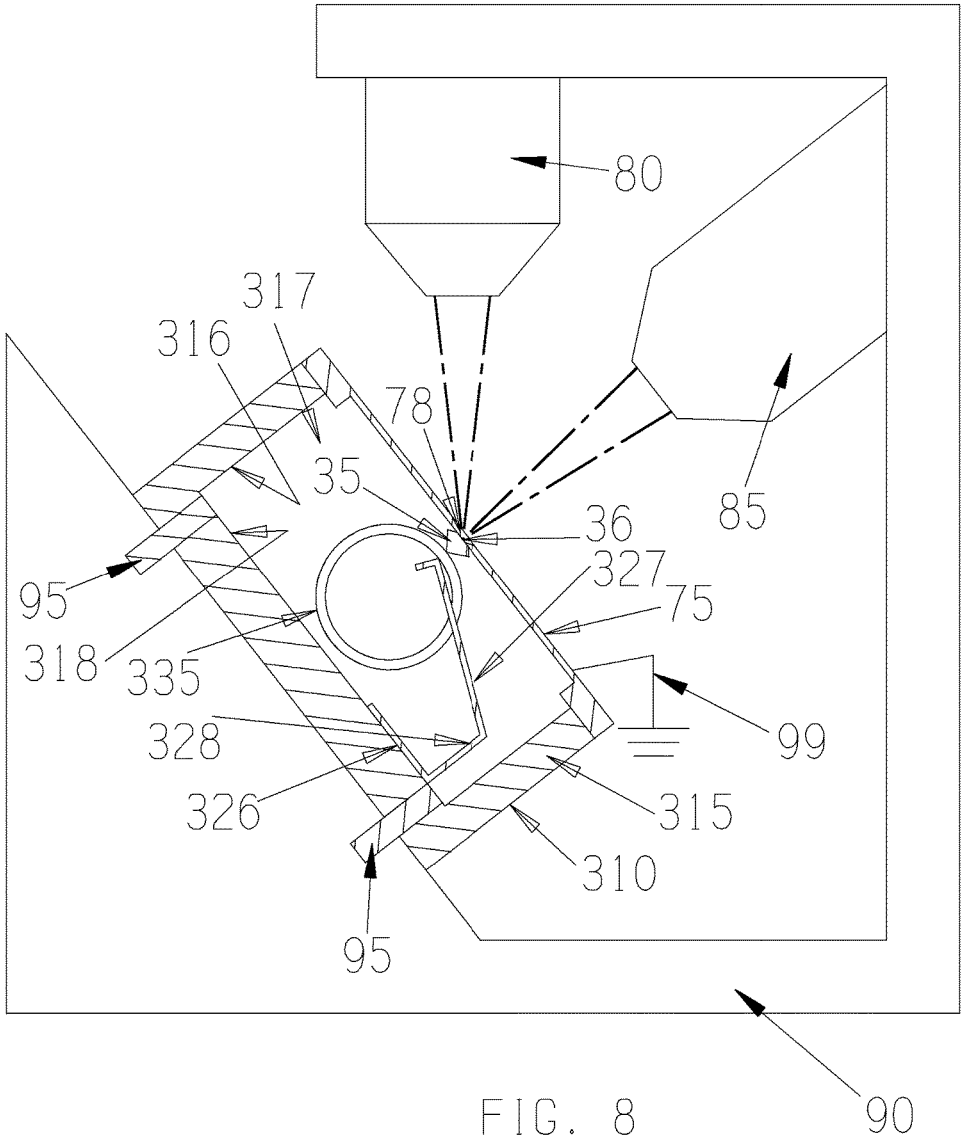
FIG. 8 is a sectional view of still another embodiment of the fixture provided by the invention, showing a gem in a setting, shown as part of an overall apparatus that includes electron beam and ion beam devices.

A fixture 310 according to another embodiment of the invention, shown in cross section in FIG. 8, is intended for use with a gem 35 that is mounted in a setting in a ring 335 or other piece of jewelry. Fixture 310 includes a body 315 that has sides 316 and a bottom surface 318, but is substantially open in the center area, forming a cavity 317, sized and shaped so as to accommodate one or more rings 335. Disposed within cavity 317 is a biasing member 325, depicted as a J-shaped metal part (although other shapes would work just as well) formed of flexible but resilient material such as spring steel. One leg 326 of biasing member 325 bears on the bottom surface 318 of the cavity 317 of the body 315, and a second leg 327 bears away from the bottom surface 318, the two legs being joined by a transverse portion 328. Biasing member 325, and specifically second leg 327, is sized and positioned so as to connect to the ring 335, and apply an upward force to the ring. Similar to the embodiments described and shown above, a cover plate 75 is placed over the top of body 315, and secured thereto with a suitable attachment. Cover plate 75 includes apertures 78, preferably matching in number, although not necessarily alignment, the number of rings 335 within the body 315, so that each ring is placed beneath one aperture 78 in the cover plate. Again, the gems 35 are not necessarily centered beneath the apertures 78, or even the work surface 36 of the gem may not be centered beneath the aperture, but it is best to center the exact spot on the work surface within the aperture. Here again, the cover plate 75, as well as possibly other parts, are made of conductive material, such as copper, brass, aluminum, steel, and so on, and the entire fixture, especially the cover plate 75, is connected to an electrical ground 99, so that any electrical charges that might otherwise build up on the work surface 36 or any of these parts is suitably and harmlessly conducted away from the work surface 36 itself, and the size of the apertures 78 is determined and set so as contribute to this functionality of conducting away charged particles.

The invention thus provides a fixture that is novel and useful in holding gems and presenting their work surfaces for various desired work, including the application of indicia by use of a high energy particle beam such as an ion beam and/or electron beam to direct charged particles onto the work surface 36.

While the apparatus described above is effectively adapted to fulfill its intended objectives as set forth, it is to be understood that the invention is not intended to be limited to the specific preferred embodiments of gemstone positioning fixture as described in this description. Rather, it is to be taken as including all reasonable equivalents to the subject matter of the claims as set out below.

The invention claimed is:

1. A gemstone positioning fixture for use in connection with a work surface of a plurality of gems, comprising:

a base, having a top surface and a bottom surface, and a plurality of plunger holes formed therein;

a plurality of biasing members, each biasing member positioned within a respective one of the plurality of plunger holes;

a plurality of plungers, each plunger positioned atop a respective one of the plurality of biasing members within the respective one of the plurality of plunger holes, each plunger having a top surface adapted to receive and support a respective one of the plurality of gems in a position so that the work surface of the respective gem faces away from the respective plunger;

an assembly applied to the bottom surface of the base, the assembly forcing the biasing members, the plungers, and the gems upward through the plunger holes in the base;

a cover plate formed of a material that conducts electricity and applied to the top surface of the base, the cover plate having a plurality of apertures matching in position and number the plurality of plunger holes in the base, each of the plurality of apertures being of a size sufficiently small that the cover plate is capable of conducting away any electrical charge that may build up on the work surfaces of the gems without a separate discharge structure to discharge any ion buildup on the work surfaces.

2. The gemstone positioning fixture as recited in claim 1 wherein the assembly includes a spring compression base plate.

3. The gemstone positioning fixture as recited in claim 1 wherein the assembly includes; a fixture base plate having spring compression pins, and positioned at the bottom of the base; a spring compression base plate, having base plate holes which align in number and position with the spring compression pins, and into which base plate holes the spring compression pins are inserted;

a spring compression plate positioned above the spring compression plate and below the biasing members, and in contact with the spring compression pins, such that when the fixture base plate is applied, the spring compression pins contact the spring compression plate, which in turn provides an upward force to the biasing members, the plungers and the gems.

4. A gemstone positioning fixture for use in connection with a plurality of gems, and for use in connection with nano-engraving a work surface of at least one of the plurality of gems by use of a focused ion beam, the fixture comprising:

a base, having a number of plunger holes formed therein;

a cover plate applied over the base, and having a number of cover plate apertures matching in position and number the number of plunger holes in the base;

a plurality of biasing members, each one of the plurality of biasing members positioned within one of the number of plunger holes;

a plurality of plungers, each one of the plurality of plungers positioned atop a respective one of the plurality of biasing member, and each one of the plurality of plungers positioned within a respective one of the number of plunger holes, each of the plurality of plungers having a top surface adapted to receive and support a gem in a position so that the work surface of that gem faces away from the plunger receiving and supporting the respective gem;

a fixture base plate having spring compression pins, and positioned below the base;

a spring compression base plate, having base plate holes which align in number and position with the spring compression pins, and into which base plate holes the spring compression pins are inserted;

a spring compression plate positioned above the spring compression base plate and below the biasing members, and in contact with the spring compression pins, such that when the fixture base plate is applied, the spring compression pins contact the spring compression plate, which in turn provides an upward force to each biasing member, each plunger, and each gem;

the cover plate formed of a material that conducts electricity, the cover plate apertures being of a size sufficiently small that the cover plate is capable of conducting away any electrical charge that may build up on the work surfaces of the gems, from the focused ion beam.

5. The gemstone positioning fixture as recited in claim 4, wherein the cover plate is connected to electrical ground.

6. The gemstone positioning fixture as recited in claim 5, wherein the material that conducts electricity is selected from the group consisting of copper, brass, steel, and aluminum.

7. A method of applying a high-energy particle beam to a work surface of a plurality of gems, the method comprising:

providing a base, having positioned in a plurality of plunger holes formed therein a number of biasing members, and a corresponding number of plungers each positioned atop each respective one of the number of biasing members;

positioning the plurality of gems each atop a respective one of the plurality of plungers;

forcing each biasing member upward, thereby forcing the respective plunger and gem upward, against a cover plate formed of an electrically conductive material and having cover apertures, such that a work surface of each of the gems is exposed through a respective one of the cover apertures; and applying a high-energy particle beam through the one of the cover apertures to the work surface of a selected one of the plurality of gems;

the cover apertures being sufficiently small that the cover plate conducts away any electrical charge that may build up on the work surface of the selected one of the plurality of gems from the high-energy particle beam without a separate discharge structure to discharge any ion buildup on the work surfaces.

8. The method as recited in claim 7 wherein the forcing step includes moving spring compression pins of a fixture base plate through a spring compression base plate and into contact with a spring compression plate, which in turn contacts the respective biasing member and forces the respective biasing member upward.

9. A method of applying a high-energy particle beam to a work surface of a plurality of gems, the method comprising:

providing a cover plate, formed of an electrically conductive material and having formed therein one or more cover plate apertures, and a plurality of biasing members, one such biasing member positioned beneath each cover plate aperture for providing an upward biasing force;

positioning one of the plurality of gems beneath a respective one of the one or more cover plate apertures;

using the upward biasing force of the plurality of biasing members, forcing each of the plurality of gems upward against the cover plate, such that the work surface of each of the plurality of gems is exposed through a respective one of the one or more cover plate apertures ; and applying a high-energy particle beam through a selected one of the cover plate apertures to the work surface of a selected one of the plurality of gems;

conducting away any electrical charge that may build up on the work surface of the selected one of the plurality of gems from the high-energy particle beam by means of the cover plate apertures being sufficiently small so as to accomplish such conducting without a separate discharge structure to discharge any ion buildup on the work surfaces.

10. The method as recited in claim 9 wherein the forcing step includes moving spring compression pins of a fixture base plate through a spring compression base plate and into contact with a spring compression plate, which in turn contacts the biasing members and forces the biasing members upward.

11. A gemstone positioning fixture for use in connection with a plurality of gems, and for use in connection with nano-engraving a work surface of at least one of the plurality of gems by use of a focused ion beam, the fixture comprising:

a base, having a plurality of cavities formed therein;

a cover plate applied over the base, and having a number of cover plate apertures formed therein;

a plurality of biasing members, each positioned within a respective one of the cavities, applying pressure to one of the plurality of gems, with the plurality of gems positioned so that the work surface of each gem is exposed to the focused ion beam through the cover plate apertures;

the cover plate formed of a material that conducts electricity, and the cover plate apertures being of a size sufficiently small that the cover plate conducts away any electrical charge that may build up on the work surface of the plurality of gems from the focused ion beam.

12. The gemstone positioning fixture as recited in claim 11, wherein the cover plate is connected to electrical ground.

13. The gemstone positioning fixture as recited in claim 12, further comprising a gem support plate supported by the plurality of biasing members and supporting the plurality of gems against the cover plate.

14. The gemstone positioning fixture as recited in claim 12 wherein each of the plurality of gems is mounted in a matching number of pieces of jewelry, and wherein each of the biasing members is attached to a respective one of the matching number of pieces of jewelry and applies pressure to the gem mounted in each piece of jewelry against the cover plate.

15. The gemstone positioning fixture as recited in claim 13 wherein the gem support plate includes a number of gem support plate openings for supporting the gems against the cover plate.

16. The gemstone positioning fixture as recited in claim 13 wherein each of the biasing members is a leaf spring.

17. The gemstone positioning fixture as recited in claim 15 wherein the gem support plate includes one or more positioning pins.

18. The gemstone positioning fixture as recited in claim 17 wherein each of the biasing members is a coil spring applied over one or more of the positioning pins.

* * * * *